US011795778B2

(12) United States Patent
Gano et al.

(10) Patent No.: US 11,795,778 B2
(45) Date of Patent: Oct. 24, 2023

(54) SWAGED IN PLACE CONTINUOUS METAL BACKUP RING

(71) Applicant: Halliburton Energy Services, Inc., Houston, TX (US)

(72) Inventors: John Charles Gano, Lowry Crossing, TX (US); Stephen Michael Greci, Little Elm, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 124 days.

(21) Appl. No.: 15/779,499

(22) PCT Filed: Oct. 26, 2016

(86) PCT No.: PCT/US2016/058885

§ 371 (c)(1),
(2) Date: May 25, 2018

(87) PCT Pub. No.: WO2018/080481

PCT Pub. Date: May 3, 2018

(65) Prior Publication Data

US 2018/0363408 A1 Dec. 20, 2018

(51) Int. Cl.
*E21B 33/12* (2006.01)

(52) U.S. Cl.
CPC ..... *E21B 33/1216* (2013.01)

(58) Field of Classification Search
CPC ..... E21B 33/1216
See application file for complete search history.

(56) References Cited

U.S. PATENT DOCUMENTS 4,288,082 A * 9/1981 Setterberg, Jr. ..... F16J 15/28 277/342
4,611,658 A * 9/1986 Salerni ..... E21B 33/1208 166/134
4,697,640 A * 10/1987 Szarka ..... E21B 33/1295 166/182

(Continued)

FOREIGN PATENT DOCUMENTS

WO 2012024041 2/2012

OTHER PUBLICATIONS

International Search Report and Written Opinion of PCT Application No. PCT/US2016/058885 dated Jul. 20, 2017: pp. 1-16.

*Primary Examiner* — Robert E Fuller
*Assistant Examiner* — Neel Girish Patel
(74) *Attorney, Agent, or Firm* — K&L Gates LLP

(57) ABSTRACT

Example systems, apparatus, and methods are described for providing continuous backup rings that are swaged into closed gland seal grooves to reduce extrusion of elastomeric sealing elements in packers. In an example embodiment, the closed gland sealing system includes a mandrel body having a cylindrical outer surface. A seal mandrel portion of the mandrel body is defined by an annular recess in the mandrel body that extends radially around the substantially cylindrical outer surface to form a closed gland groove. A sealing element is positioned in the closed gland groove and extends radially around the seal mandrel portion. Further, a continuous backup ring is positioned in contact with the sealing element in the closed gland groove that also extends radially around the seal mandrel portion.

14 Claims, 4 Drawing Sheets

(56) References Cited

U.S. PATENT DOCUMENTS 4,730,835 A * 3/1988 Wilcox ..... F16J 15/166 166/120
5,103,904 A * 4/1992 Luke ..... E21B 33/1216 166/195
5,230,387 A * 7/1993 Waters ..... G01V 3/26 175/45
5,267,620 A * 12/1993 Lee ..... E21B 23/02 175/246
5,380,016 A * 1/1995 Reinsma ..... F16J 15/3208 277/503
5,709,418 A * 1/1998 Benson ..... F16L 13/146 285/382.2
6,044,908 A * 4/2000 Wyatt ..... E21B 34/14 277/648
6,622,788 B2 * 9/2003 Kaiser ..... E21B 17/08 166/195
8,333,255 B2 * 12/2012 Drenth ..... E21B 25/02 175/246
8,485,280 B2 * 7/2013 Drenth ..... E21B 23/02 175/246
8,701,787 B2 4/2014 Shkurti et al.
2001/0006109 A1 * 7/2001 Michael Victor Kaiser ..... E21B 17/08 166/242.1
2002/0043368 A1 * 4/2002 Bell ..... E21B 33/1216 166/118
2003/0080515 A1 * 5/2003 Milberger ..... E21B 33/04 277/603
2003/0141079 A1 * 7/2003 Doane ..... E21B 33/129 166/387
2005/0173126 A1 * 8/2005 Starr ..... E21B 33/134 166/134
2006/0266514 A1 * 11/2006 Abarca ..... E21B 33/134 166/118
2010/0038074 A1 2/2010 Patel
2012/0030917 A1 * 2/2012 Danhash ..... B21D 39/04 72/453.01
2012/0205872 A1 * 8/2012 Reinhardt ..... E21B 43/103 277/336
2013/0192853 A1 * 8/2013 Themig ..... E21B 33/128 166/134
2014/0209292 A1 * 7/2014 Watson ..... F04D 13/10 166/105
2015/0029035 A1 * 1/2015 Hejleh ..... E21B 47/12 340/854.4
2015/0192232 A1 * 7/2015 Clevelario ..... F16L 33/01 285/222.1
2016/0032681 A1 * 2/2016 McGruddy ..... E21B 33/1216 277/336
2016/0245038 A1 * 8/2016 Stokes ..... E21B 33/1216
2017/0002634 A1 * 1/2017 Casey ..... F04B 47/12
2017/0183920 A1 * 6/2017 Ribble ..... E21B 17/1078

* cited by examiner

SWAGED IN PLACE CONTINUOUS METAL BACKUP RING

BACKGROUND

In high pressure applications, an open gland seal groove can reduce the strength of the sealing mandrel. Further, open gland seal grooves may be avoided due to system geometry or cost. As a result, closed gland sealing grooves are sometimes used in high pressure applications. Sometimes, the sealing element used in closed gland sealing systems can extrude into the clearance of mating surfaces when subjected to increasing pressures, which may lead to loosening of the sealing element and leakage. Some conventional systems use a cut backup ring in an attempt to reduce the extrusion of the sealing element.

For example, some split backup ring designs use a split ring with a scarf cut. However, cut backup rings are susceptible to being prematurely pulled up, for example by bumping into something during RIH (run in hole) operations or getting pulled out due to high fluid flow traveling over the cut backup ring, for example by shifting a sleeve open while its under pressure.

DETAILED DESCRIPTION

To address some of the challenges described above, as well as others, apparatuses and methods are described herein that operate to provide continuous backup rings that are swaged into closed gland seal grooves to reduce extrusion of elastomeric sealing elements in closed gland sealing systems. In at least one example, the backup rings are swaged, or otherwise reduced diametrically by force.

Figure 1:
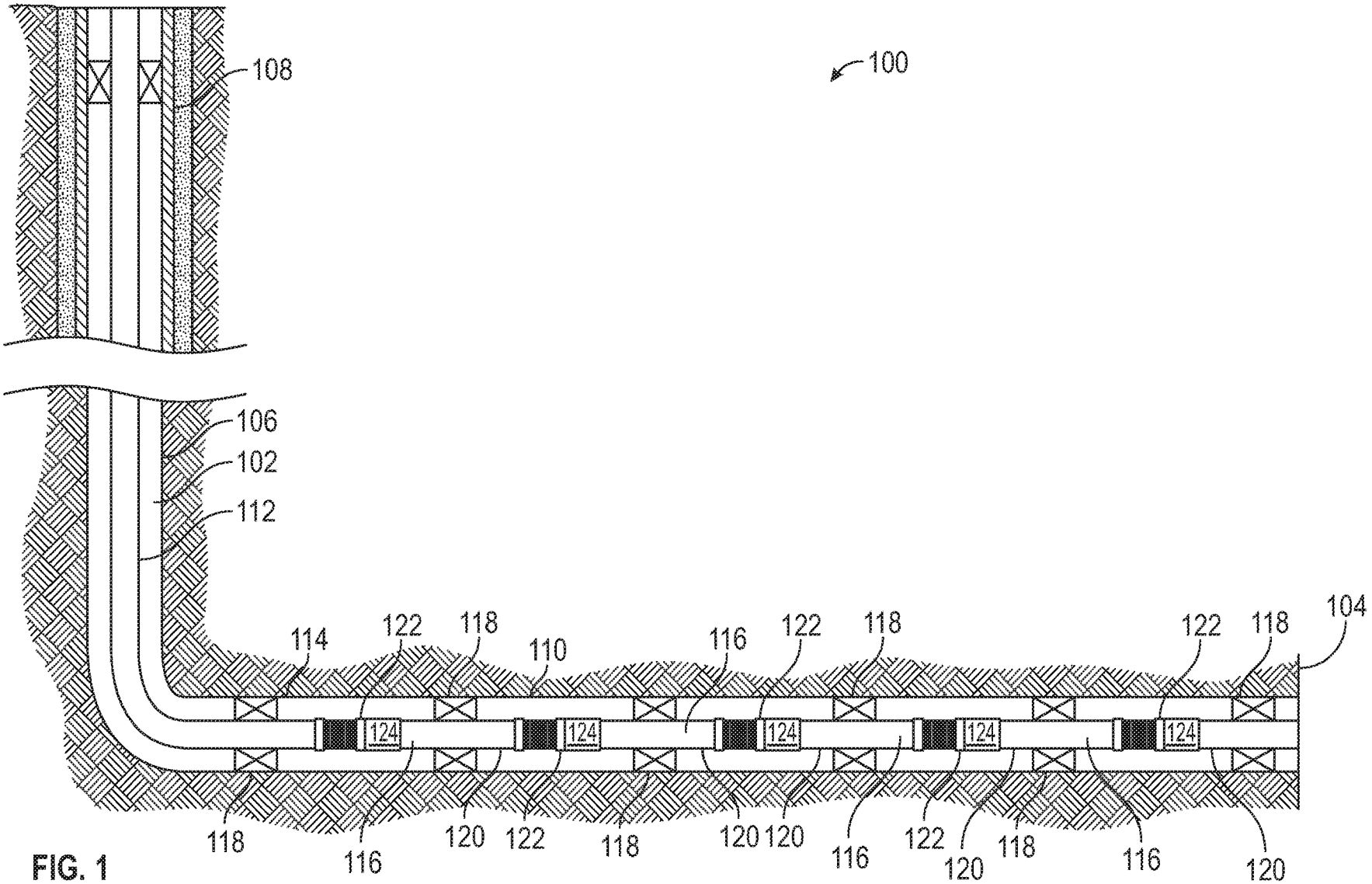
FIG. 1 is a schematic diagram illustrating an example well system, according to one or more embodiments.

FIG. 1 is a schematic diagram illustrating an example well system 100 in which a high pressure sealing system may be deployed, according to one or more embodiments. In well system 100, a wellbore 102 is drilled extending through various earth formations into a formation of interest 104 containing hydrocarbons. Those skilled in the art will readily recognize that the principles described herein are applicable to land-based, subsea-based, or sea-based operations, without departing from the scope of the disclosure. The wellbore 102 includes a substantially vertical section 106, the upper portion of which is cased by a casing string 108 that is cemented in place inside the wellbore 102. The wellbore 102 can also include substantially horizontal section 110 that extends through the formation of interest 104.

As illustrated, the horizontal section 110 of the wellbore 102 is open hole. However, those skilled in the art will readily recognize that the principles described herein are also applicable to embodiments in which the horizontal section 110 of the wellbore 102 includes borehole-lining tubing, such as casing and/or liner. Further, although FIG. 1 depicts a well having a horizontal section 110, it should be understood by those skilled in the art that this disclosure is also applicable to well systems having other directional configurations including, but not limited to, vertical wells, deviated well, slanted wells, multilateral wells, and the like.

Accordingly, it should be understood that the use of directional terms such as "above", "below", "upper", "lower", "above", "below", "left", "right", "uphole", "downhole" and the like are used in relation to the illustrative embodiments as they are depicted in the figures, the above direction being toward the top of the corresponding figure, the below direction being toward the bottom of the corresponding figure, and the uphole direction being toward the surface of the well and the downhole direction being toward the toe of the wellbore 102, even though the wellbore or portions of it may be deviated or horizontal. Correspondingly, the "transverse" or "radial" orientation shall mean the orientation perpendicular to the longitudinal or axial orientation. In the discussion which follows, generally cylindrical well, pipe and tube components are assumed unless expressed otherwise.

A tubular 112 (e.g., production tubing) extending from the surface is suspended inside the wellbore 102 for recovery of formation fluids to the earth's surface. The tubular 112 provides a conduit for formation fluids to travel from the formation of interest 104 to the surface and can also be used as a conduit for injecting fluids from the surface into the formation of interest 104. At its lower end, tubular 112 is coupled to a completion string 114 that has been installed in wellbore 102 and divides the horizontal section 110 into various production intervals.

The completion string 114 includes a plurality of screen joints 116 that are coupled together sequentially to form the completion string 114. Each screen joint can include a base pipe 120 and a flow control screen 122 that circumferentially surrounds at least a portion of the base pipe 120. The flow control screens 122 of the screen joints 116 operate to filter unwanted particulates and other solids from formation fluids as the formation fluids enter the completion string 114. As described herein, "formation fluids" refers to hydrocarbons, water, and any other substances in fluid form that may be produced from an earth formation.

In some embodiments, the base pipes 120 are pipe segments that include suitable connection mechanisms, such as threaded configurations, to connect each screen joint 116 to adjacent components. For example, adjacent pairs of screen joints 116 are coupled together at a screen joint connection (not shown), with the number of screen joints 116 and screen joint connections varying depending on the length of the screen joints and the wellbore in which they are deployed.

Each of the screen joints 116 are positioned between packers 118 that provide a fluidic seal between the completion string 114 and the wellbore 102, thereby defining the production intervals. The packers 118 isolate the annulus between the completion string 114 and the wellbore 102, thereby allowing formation fluid flow to enter the completion string 114 instead of flowing up the length of the casing along the exterior of the production string. The packers are designed to radially expand outwards against the wellbore wall (or inner diameter of the borehole-lining tubing if present).

The system 100 includes a sealing system 124. In at least one example the sealing system 124 includes a closed-gland seal. For example, the sealing system 124 can be associated with a sliding sleeve moved under pressure. In some examples, the sealing system includes a sealing element comprised of rubber or some other elastomeric material. In situations where the sealed pressure is high (e.g., above 5,000 psi), the elastomeric sealing element can begin to extrude and be pushed out through the extrusion gap. This can lead to a loss of seal and may therefore cause leakage. In at least one example, the sealing system 124 includes a backup ring which can be positioned proximate to and in contact with the sealing element to prevent or limit the sealing element from extruding. In at least one example, the backup ring is positioned on the side of the sealing element that has lower pressure, such that it operates to close the extrusion gap as the sealing element is forced in the direction of the extrusion gap.

It is to be recognized that system 100 is merely exemplary in nature and various additional components can be present that have not necessarily been depicted in FIG. 1 in the interest of clarity. Non-limiting additional components that can be present include, but are not limited to, supply hoppers, valves, condensers, adapters, joints, gauges, sensors, compressors, pressure controllers, pressure sensors, flow rate controllers, flow rate sensors, temperature sensors, and the like. Such components can also include, but are not limited to, wellbore casing, wellbore liner, completion string, insert strings, drill string, coiled tubing, slickline, wireline, drill pipe, drill collars, mud motors, downhole motors and/or pumps, surface-mounted motors and/or pumps, centralizers, turbolizers, scratchers, floats (e.g., shoes, collars, valves, and the like), logging tools and related telemetry equipment, actuators (e.g., electromechanical devices, hydromechanical devices, and the like), sliding sleeves, production sleeves, screens, filters, flow control devices (e.g., inflow control devices, autonomous inflow control devices, outflow control devices, and the like), couplings (e.g., electro-hydraulic wet connect, dry connect, inductive coupler, and the like), control lines (e.g., electrical, fiber optic, hydraulic, and the like), surveillance lines, drill bits and reamers, sensors or distributed sensors, downhole heat exchangers, valves and corresponding actuation devices, tool seals, packers, cement plugs, bridge plugs, and other wellbore isolation devices or components, and the like. Any of these components can be included in the well system 100 generally described above and depicted in FIG. 1.

Figure 2A:
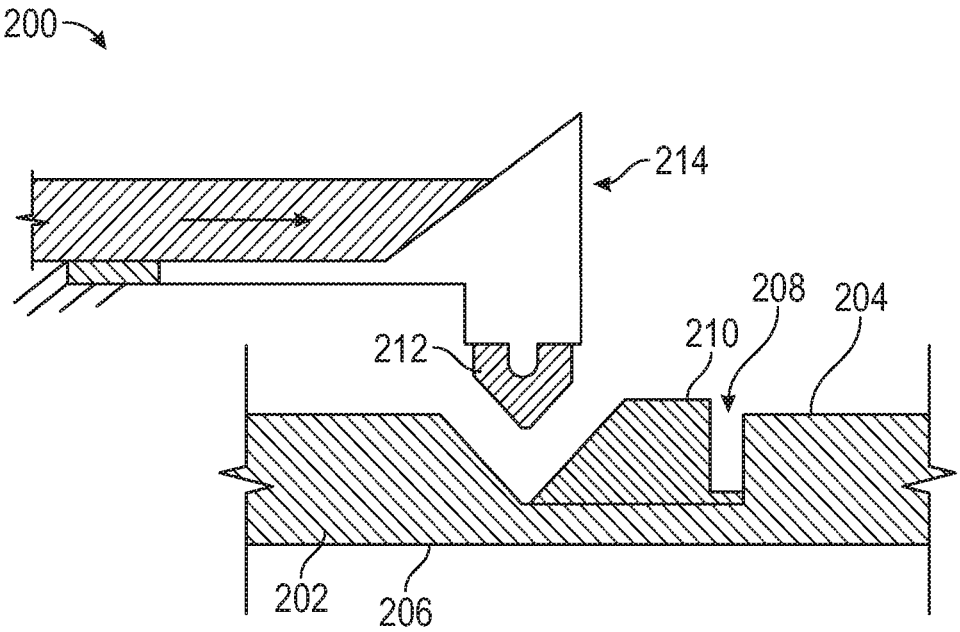
FIG. 2A is a depiction of a swaging operation applied to a backup ring, according to one or more embodiments.

FIG. 2 is a cross-sectional view of a closed gland sealing system 200 in which a swaging operation is applied to a backup ring 212, according to one or more embodiments. In FIG. 2A, the backup ring 212 is shown in its "as-machined" diameter, with the die about to swage it As shown, the closed gland sealing system 200 includes a mandrel body 202 having an outer surface 204 and an inner surface 206. In some embodiments, the mandrel body 202 of the closed gland sealing system 200 is a cylindrically-shaped, tubular member. Accordingly, the outer surface 204 corresponds to an outer diameter and the inner surface 206 corresponds to an inner diameter of the mandrel body 202. As the general construction and operations of closed gland sealing system are well known, they will not be discussed in further detail here.

Figure 2B:
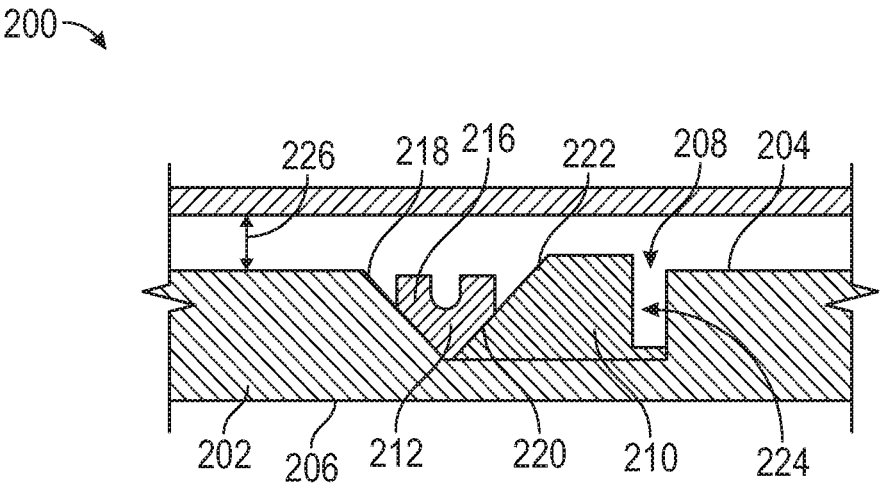
FIG. 2B is a cross-sectional view along a wall thickness of a closed gland sealing system after a backup ring has been installed, according to one or more embodiments.

The outer surface 204 of mandrel body 202 includes a closed gland seal groove 208. The closed gland seal groove 208 is an annular recess that is formed in the mandrel body 202. As shown in FIG. 2B, the closed gland groove 208 comprising an annular recess formed in the mandrel body 202 and extends radially around the cylindrical outer surface 204. The closed gland groove 208 comprises a fixed back slope 218 and a wall that are both monolithic with the mandrel bod 202 and form the annular recess. In closed glands, seals and/or backup rings are generally compressed and contorted or stretched in order to fit into the gland. In contrast, open glands typically have removable parts that allow seals or backup rings to easily fit into a gland cavity. In open gland seal grooves, seals and/or backup rings are slid into position and then axially retained using, for example, threaded retainers. It is noted that closed glands, such as closed gland sealing groove 208, are beneficial in high pressure applications due to open gland seal grooves causing a reduction in the strength of the sealing mandrel (e.g., mandrel body 202). Closed gland seals also allow for a simpler construction of the mandrel and less parts overall, since you do not need any extra components for axial retaining of the seal.

A compressible, sealing element 210 is positioned in the closed gland seal groove 208 of the mandrel body 202. The sealing element 210 is preferably formed of an elastomer, as is known in the art. This can be a simple o-ring of a certain cross section, a molded in-place seal, or other. For example, according to various example embodiments, the sealing element 210 includes one or more elastomeric materials such as hydrogenated nitrile butadiene rubber ("HNBR"), nitrile butadiene rubber ("NBR"), perfluoro-elastomers ("FFKM"), tetrafluoro ethylene/propylene copolymer rubbers ("FEPM"), fluoro-elastomers ("FKM"), neoprene and natural rubber. The seal could also be non-elastomeric seal such as PEEK.

The backup ring 212 can be installed in a closed gland groove next to the sealing element 210 using a swaging device 214 (e.g., a wedged collet swaging device). The swaging device 214 is configured to and operates by reducing the diameter of the backup ring 212 until it is fully seated into the closed gland seal groove 208 adjacent to the sealing element 210. In some embodiments, swaging comprises resizing the backup ring 212 by reducing its diameter. Similar to the sealing element 210, the backup ring 212 is positioned in the closed gland seal groove 208 and extends radially around the external circumferential surface of the annular recess in the mandrel body 202. In at least one example, the backup ring 212 is initially sized so that it can fit over the outer surface of the mandrel body 202 prior to swaging.

In general, the backup ring 212 is constructed from a relatively rigid material compared to the sealing element 210. In this particular embodiment, the backup ring 212 is formed of metal, metallic alloys, composites, a combination of these, or the like. Suitable examples of alloys include, but are not limited to, beryllium copper, bronze, brass, steel, etc. Suitable examples of plastics and thermoplastics include, but are not limited to, polyphenylene sulfide (PPS), polyaryletherketone (PAEK), amorphous polymers, polyimides (PI), polyamides (PA), and sulfones. In some embodiments, the plastic material may be cross-linked such as thermosets, true epoxies, phenolics, and cross-linked PAEK.

The backup ring 212 comprises a continuous ring that is formed as one unitary piece without cutting and/or joining (e.g., non-scarf cut). In contrast, other backup rings are manufactured by cutting the backup rings at an angle relative to both its horizontal and vertical planes (i.e., at a compound angle) to form a scarf cut. The resulting closed gland sealing system 200, as illustrated in FIG. 2B for example, comprises a continuous backup ring that is swaged into position within a closed gland seal.

Accordingly, FIG. 2B shows a cross-sectional view along a wall thickness of the closed gland sealing system 200 after backup ring 212 has been installed, according to one or more embodiments. In typical operation, the closed gland sealing system 200 can be located on a work string for selectively isolating various underground formations or zones of interest within a completed wellbore. In some examples, the sealing system can be installed on the tool to seal in a seal bore downhole. In some examples the sealing system, can be inserted into a seal bore on the surface and run down as an assembled tool.

As shown, after swaging, the backup ring 212 is positioned adjacent the sealing element 210. The backup ring 212 has a first end portion 216 that extends radially outwardly from the mandrel body 202 and along a back slope on the seal mandrel 218 that the backup ring 212 rides against. The backup ring 212 also has a second end portion 220 that extends radially outwardly from the mandrel body 202 and is in contact with an end portion 222 of the sealing element 210. The backup ring 212 is typically deployed in response to a setting force (e.g., pressure) being exerted on the second end portion 220 of the backup ring 212 from the end portion 222 of the sealing element 210.

In this embodiment, the end portion 222 of the sealing element 210 is a sloped surface that is in physical contact with a sloped surface at the second end portion 220 of the backup ring 212. However, one of ordinary skill in the art will recognize that various other configurations can be used at the interface between the second end portion 220 of the backup ring 212 and the end portion 222 of the sealing element 210. For example, FIGS. 4A-4F, as discussed below, discuss some example embodiments of differing configurations.

The closed gland sealing system 200 further includes an optional recess 224 that provides an annulus-shaped area between the sealing element 210 and the mandrel body 202 that allows for thermal expansion or swelling of the sealing element 210, which helps to prevent premature activation of the backup ring 212. In at least one example, the seal mandrel includes a thermal expansion recess that extends radially around the seal mandrel portion.

It is noted that the elastomeric material of the sealing element 210 will generally be subject to extruding at higher pressures. In various embodiments, the sealing element 210 will start to extrude when subjected to pressure in the range of 5,000-15,000 psi, as is usual and customary for sealing elements of closed gland sealing systems. Similarly, the backup ring 212 can have a rigidity that allows it to be activated at similar pressures and depending upon the materials from which it is constructed and its various configurations (as further discussed below). In at least one example, the backup ring is activated (i.e., the backup ring expands out diametrically) to block the extrusion gap and prevent the seal from extruding, or flowing, into the extrusion gap.

When the sealing element 210 is engaged with sufficient force, the engagement of the end portion 222 with the second end portion 220 of the backup ring 212 causes the backup ring 212 to expand and ride up along the back slope on the seal mandrel 218. The expansion of the backup ring 212 (not shown) closes the extrusion gap 226 that the sealing element 210 might otherwise extrude into. As previously noted, the pressure at which the backup ring 212 expands can be controlled by a few variables that may be adjusted for various applications. Such variables can include, but are not limited to, the angle of the back slope on the seal mandrel that the backup ring rides against, the cross-sectional area of the backup ring, the shape and surface area at the interface between the backup ring and the sealing element, and the material properties of the backup ring.

Figure 3:
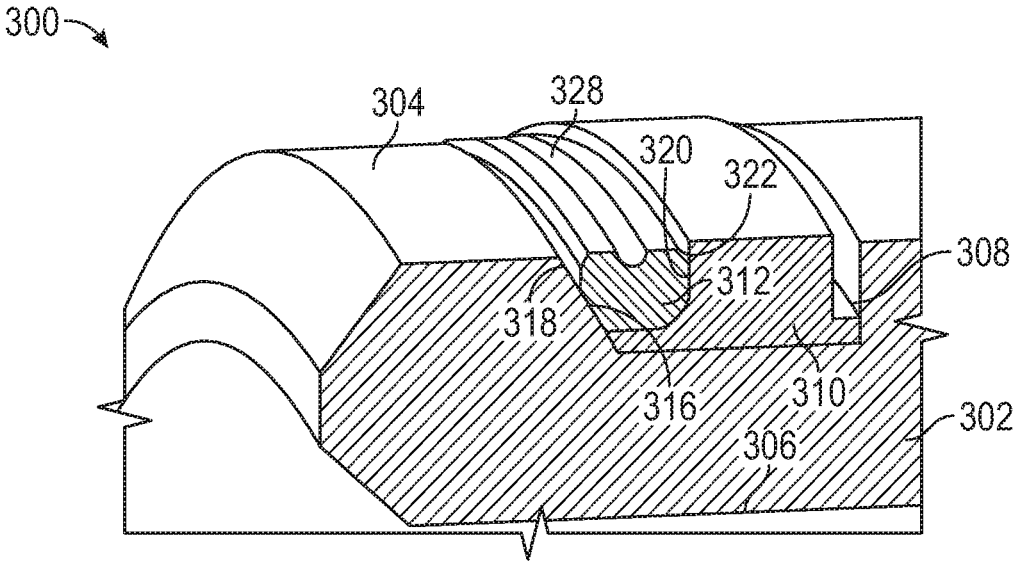
FIG. 3 is a perspective view of an example closed gland sealing system with a backup ring, according to one or more embodiments.

Referring now to FIG. 3, illustrated is a perspective view of an example closed gland sealing system with the backup ring swaged into position, according to one or more embodiments. Similar to closed gland sealing system 200 of FIGS. 2A-2B, the closed gland sealing system 300 includes a mandrel body 302 having an outer surface 304 and an inner surface 306. As shown, the mandrel body 302 of the closed gland sealing system 300 is a cylindrically-shaped, tubular member. Accordingly, the outer surface 304 corresponds to an outer diameter and the inner surface 306 corresponds to an inner diameter of the mandrel body 302.

The outer surface 304 of mandrel body 302 includes a closed gland seal groove 308. The closed gland seal groove 308 is an annular recess that is formed in the mandrel body 302. A compressible, sealing element 310 is positioned in the closed gland seal groove 308 and is radially wrapped around the external circumferential surface of the annular recess in the mandrel body 302. The sealing element 310 is preferably formed of a elastomer, as is known in the art.

A backup ring 312 can be installed in the closed gland seal groove 308 adjacent to the sealing element 310. The backup ring 312 comprises a continuous backup ring that is formed as one unitary piece without cutting and/or joining (e.g., non-scarf cut). It is noted that the backup ring 312 can optionally include a groove 328 or some other feature on the outer diameter of the backup ring 312 to be used as a positioning guide in the swaging device. As shown, the backup ring has been swaged into position in the closed gland seal groove 308 and extends radially around the external circumferential surface of the annular recess in the mandrel body 302.

The backup ring 312 has a first end portion 316 that extends radially outwardly from the mandrel body 302 and along a back slope on the seal mandrel 318 that the backup ring 312 rides against. The backup ring 312 also a second end portion 320 that extends radially outwardly from the mandrel body 302 and is in contact with an end portion 322 of the sealing element 310. The backup ring 312 is typically deployed in response to a force (e.g., pressure) being exerted on the second end portion 320 of the backup ring 312 from the end portion 322 of the sealing element 310.

In this embodiment, the end portion 322 of the sealing element 310 and the second end portion 320 of the backup ring 312 form a rounded corner type shape in relation to each other. This rounded corner represents one configuration by which the contact surface area between backup ring 312 and sealing element 310 can be increased, such as relative to the sloped surfaces of closed gland sealing system 200 in FIGS. 2A-2B.

When the sealing element 310 is engaged with sufficient force, the engagement of the end portion 322 with the second end portion 320 of the backup ring 312 causes the backup ring 312 to expand and ride up along the back slope on the seal mandrel 318. In various embodiments, the setting force for the sealing element 310 can be in the range of 5,000-15,000 psi. Similarly, the backup ring 312 can have a rigidity that allows it to be deployed at similar setting forces to that of the sealing element 310, and depending upon the materials from which it is constructed and its various configurations. This particular backup ring 312 is designed to expand out with approximately less than 5,000 psi on the sealing element 310.

It is noted that the back slope on the seal mandrel 318 has a relatively high angle (e.g., greater than 45 degrees and preferably closer to 60 degrees), which makes it easier for the backup ring 312 to retract upon pressure relief. Thus, high angled back slopes on the seal mandrel are well suited for dynamic applications, such as in sliding sleeves, where it is desirable for backup rings to drop down after pressure is reduced. For non-dynamic applications, it may be desirable for backup rings to lock in position after initial activation, so low angled back slopes would be used (e.g., lower than 45 degrees and preferably closer to 30 degrees).

FIGS. 4A-4F are side-cross section views illustrating various continuous backup ring configurations, according to one or more embodiments. These configurations represent just a few configurations that can impact activation of the backup ring. For example, as shown FIG. 4A, the configuration can be changed such that interface between sealing element 402 and backup ring 404 has an increased surface area (e.g., relative to the example configuration of FIG. 4B, which is similar to the example configurations of FIGS. 2A-2B but does not have a groove on the outer diameter of backup ring 404 to help with alignment during swaging). This increased interface area can lead to improved energy transfer from sealing element 402 to backup ring 404, which makes it relatively easier to activate the backup ring 404. It is noted that in this example, the back slope of the seal mandrel 406 has a slope of approximately 45 degrees.

Figure 4A:
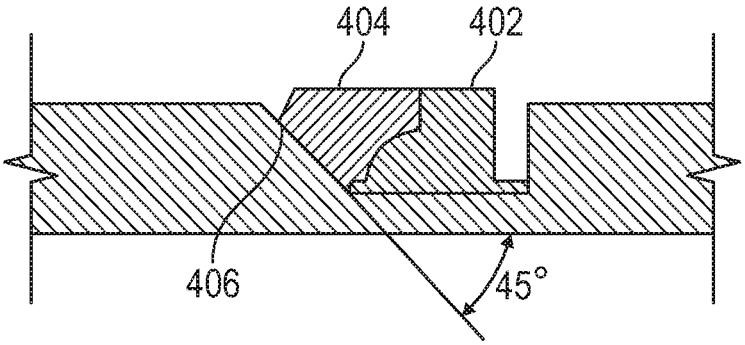
FIGS. 4A-4F are side-cross section views illustrating various continuous backup ring configurations, according to one or more embodiments.
Figure 4B:
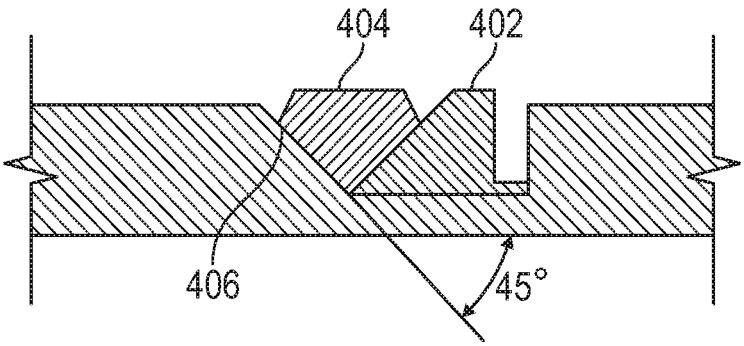
Figure 4C:
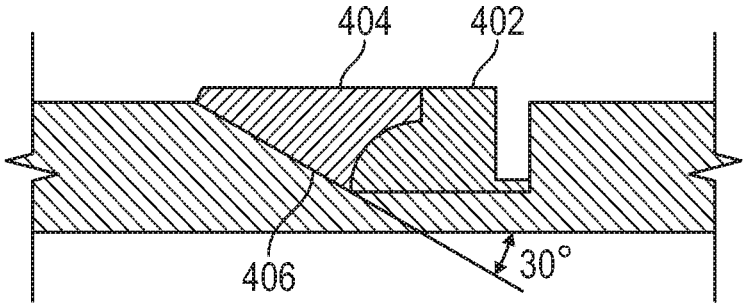
Figure 4D:
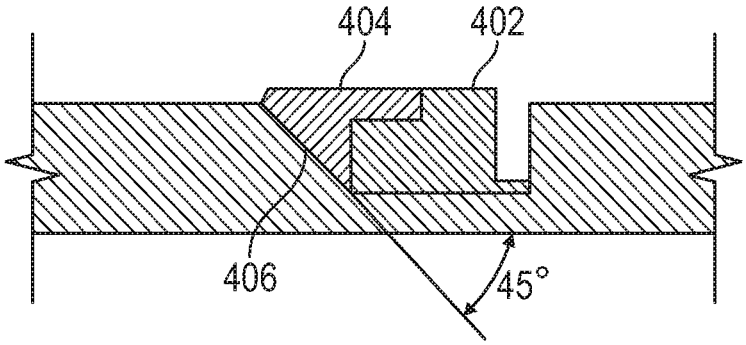
Figure 4E:
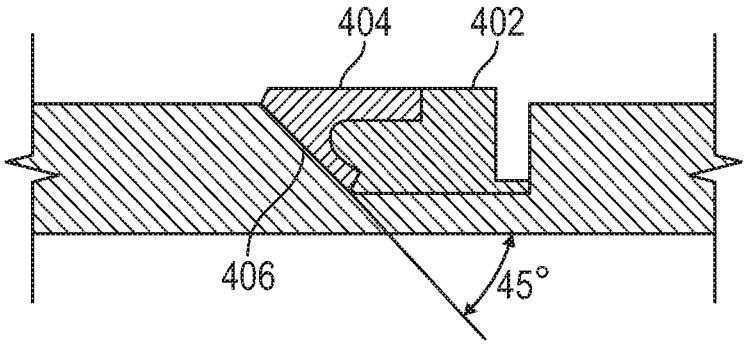

In the example configuration of FIG. 4C, the back slope of the seal mandrel 406 has a slope of approximately 30 degrees. Further, the sealing element 402 occupies more space within the seal groove such that the backup ring 404 has decreased contact with the back slope of the seal mandrel 406. Both of these modifications make it easier to activate the backup ring 404. Accordingly, the backup ring of FIG. 4C will expand sooner than those of FIGS. 4B-4C when exposed to similar pressure conditions. Similarly, FIGS. 4D-4E illustrate example configurations in which the mass of the backup ring 404 and/or the surface area between the backup ring 404 and the sealing element 402 have been reduced, which make it easier to activate the backup ring 404.

Figure 4F:
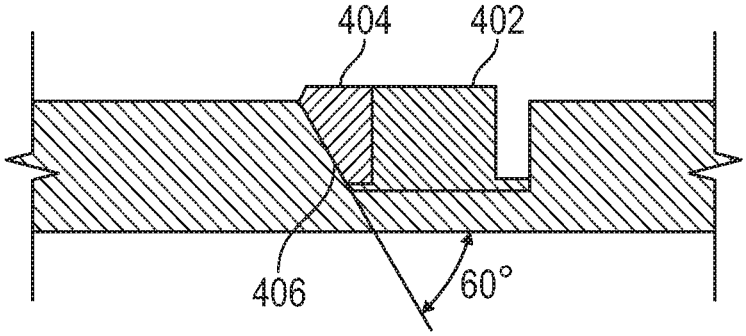

In contrast, the example configuration of FIG. 4F has a back slope of the seal mandrel 406 being angled at approximately 60 degrees. In this example, the sealing element is configured such that the backup ring 404 has contact with substantially the entirety of the back slope of the seal mandrel 406. Further, only a small area of the sealing element 402 is able to provide loading forces radially away from the mandrel body; the majority of the contact surface area between sealing element 402 and backup ring 404 is configured such that forces are exerted against the high angled back slope of the seal mandrel 406. Accordingly, these factors make it more difficult to activate and expand the backup ring 404. In other words, the rate at which the backup ring 404 expands decreases as the angle of the back slope of the seal mandrel 406 increases. In at least one example, the high angle means it is easier for the backup ring to slide back down the slope after the pressure is relieved.

It is noted that although the embodiments of FIGS. 2A-4F are depicted for closed gland sealing systems having a single backup ring, it should be appreciated by those of ordinary skill in the art that this disclosure is also applicable to configurations having two or more backup rings positioned with closed gland seal grooves. For example, alternative embodiments can include two backup rings within the same seal groove, with one backup ring positioned on both ends of the sealing element.

Many advantages can be gained by implementing the apparatuses and methods described herein. For example, in some embodiments, continuous backup rings are swaged into a closed gland seal groove that reduces extrusion gap as pressure is increased. The swaging of the backup ring within closed gland sealing grooves uses fewer extra parts relative to structures typically associated with open gland grooves. Further, the continuous backup rings enable increases in the pressure rating of closed gland seals, which can be rated for use at pressures of 20,000 psi (e.g., 20 ksi) or higher. The use of closed gland sealing grooves are beneficial in high pressure applications where the strength of the sealing mandrel can be reduced by open gland seal grooves, thus enabling usage under higher pressures and with a longer life span.

Although specific embodiments have been illustrated and described herein, it should be appreciated that any arrangement calculated to achieve the same purpose may be substituted for the specific embodiments shown. This disclosure is intended to cover any and all adaptations or variations of various embodiments. Combinations of the above embodiments, and other embodiments not specifically described herein, will be apparent to those of skill in the art upon reviewing the above description.

Although specific embodiments have been illustrated and described herein, it will be appreciated by those of ordinary skill in the art that any arrangement that is calculated to achieve the same purpose may be substituted for the specific embodiments shown. Various embodiments use permutations or combinations of embodiments described herein.

The following numbered examples are illustrative embodiments in accordance with various aspects of the present disclosure.

1. A closed gland sealing system may include a mandrel body having a substantially cylindrical outer surface, in which a seal mandrel portion of the mandrel body is defined by an annular recess in the mandrel body that extends radially around the substantially cylindrical outer surface to form a closed gland groove; a sealing element positioned in the closed gland groove and extending radially around the seal mandrel portion; and a continuous backup ring positioned proximate to the sealing element in the closed gland groove, in which the continuous backup ring extends radially around the seal mandrel portion.
2. The closed gland sealing system of example 1, in which the continuous backup ring includes a continuous metal backup ring.
3. The closed gland sealing system of any of the preceding examples, in which the continuous backup ring is swaged into position by reducing a diameter of the continuous backup ring to be seated within the closed gland groove.
4. The closed gland sealing system of any of the preceding examples, in which the closed gland groove further includes a back slope between the seal mandrel portion and the substantially cylindrical outer surface of the mandrel body.
5. The closed gland sealing system of any of the preceding examples, in which the continuous backup ring rides along the back slope as the continuous backup ring expands radially outward from the seal mandrel portion of the mandrel body upon activation of the continuous backup ring.
6. The closed gland sealing system of any of the preceding examples, in which a rate at which the continuous backup ring expands decreases as an angle of the back slope increases.
7. The closed gland sealing system of any of the preceding examples, in which the seal mandrel portion further includes a thermal expansion recess that extends radially around the seal mandrel portion.
8. A system may include a production tubing within a wellbore, in which the wellbore is encased with wellbore casing; and a closed gland sealing system deployed along the production tubing, in which the closed gland sealing system includes: a mandrel body having a substantially cylindrical outer surface, in which a seal mandrel portion of the mandrel body is defined by an annular recess in the mandrel body that extends radially around the substantially cylindrical outer surface to form a closed gland groove; a sealing element positioned in the closed gland groove and extending radially around the seal mandrel portion; and a continuous backup ring positioned in contact with the sealing element in the closed gland groove, in which the continuous backup ring extends radially around the seal mandrel portion.

9. The system of example 8, in which the continuous backup ring includes a continuous metal backup ring.

10. The system of any of the preceding examples, in which the continuous backup ring is swaged into position by reducing a diameter of the continuous backup ring to be seated within the closed gland groove.

11. The system of any of the preceding examples, in which the closed gland groove further includes a back slope between the seal mandrel portion and the substantially cylindrical outer surface of the mandrel body.

12. The system of any of the preceding examples, in which the continuous backup ring rides along the back slope as the continuous backup ring expands radially outward from the seal mandrel portion of the mandrel body upon activation of the continuous backup ring.

13. The system of any of the preceding examples, in which a rate at which the continuous backup ring expands decreases as an angle of the back slope increases.

14. The system of any of the preceding examples, in which an extrusion gap between the substantially cylindrical outer surface of the mandrel body and the wellbore casing is reduced upon activation of the continuous backup ring.

15. The system of any of the preceding examples, in which the continuous backup ring expands in response to a setting force transferred to the continuous backup ring from the sealing element.

16. A method may include: deploying a closed gland sealing system along a tubular in which the closed gland sealing system includes: a mandrel body having a substantially cylindrical outer surface, in which a seal mandrel portion of the mandrel body is defined by an annular recess in the mandrel body that extends radially around the substantially cylindrical outer surface to form a closed gland groove; a sealing element positioned in the closed gland groove and extending radially around the seal mandrel portion; a continuous backup ring positioned in contact with the sealing element in the closed gland groove, in which the continuous backup ring extends radially around the seal mandrel portion; and activating the continuous backup ring to reduce an extrusion gap between the substantially cylindrical outer surface of the mandrel body and a seal bore.

17. The method of example 16, in which activating the continuous backup ring includes transferring a setting force from the sealing element to the continuous backup ring.

18. The method of any of examples 16-17, in which activating the continuous backup ring includes increasing pressure forces experienced by the sealing element and the continuous backup ring.

19. The method of any of examples 16-18, further including: retracting the continuous backup ring by reducing pressure forces experienced by the sealing element and the continuous backup ring.

20. The method of any of examples 16-19, in which retracting the continuous backup ring causes the continuous backup ring to drop down into the closed gland groove.

The accompanying drawings that form a part hereof, show by way of illustration, and not of limitation, specific embodiments in which the subject matter may be practiced. The embodiments illustrated are described in sufficient detail to enable those skilled in the art to practice the teachings disclosed herein. Other embodiments may be utilized and derived therefrom, such that structural and logical substitutions and changes may be made without departing from the scope of this disclosure. This Detailed Description, therefore, is not to be taken in a limiting sense, and the scope of various embodiments is defined only by the appended claims, along with the full range of equivalents to which such claims are entitled.

What is claimed is:

1. A closed gland sealing system, comprising:

a mandrel body having a cylindrical outer surface, wherein a seal mandrel portion of the mandrel body comprises a closed gland groove comprising an annular recess formed in the mandrel body and extending radially around the cylindrical outer surface, the closed gland groove comprising a fixed back slope and a wall that are both monolithic with the mandrel body and form the annular recess;

a sealing element positioned in, axially retained by, and extending radially around the closed gland groove; and a continuous backup ring positioned proximate the sealing element in the closed gland groove, the continuous backup ring swaged into position by reducing a diameter of the continuous backup ring to be seated within the closed gland groove, wherein the continuous backup ring extends radially around the closed gland groove and rides along the back slope as the continuous backup ring expands radially outward from the mandrel body upon activation of the continuous backup ring, the continuous backup ring being in contact with the back slope prior to activation.

2. The closed gland sealing system of claim 1, wherein the continuous backup ring comprises a continuous metal backup ring.

3. The closed gland sealing system of claim 1, wherein a rate at which the continuous backup ring expands decreases as an angle of the back slope increases.

4. The closed gland sealing system of claim 1, wherein the seal mandrel portion further comprises a thermal expansion recess that extends radially around the seal mandrel portion.

5. A system for use in a wellbore, comprising:

a seal bore within the wellbore;

a tubing within the wellbore; and a closed gland sealing system deployed along the tubing, wherein the closed gland sealing system includes:

a mandrel body having a cylindrical outer surface, wherein a seal mandrel portion of the mandrel body comprises a closed gland groove comprising an annular recess formed in the mandrel body and extending radially around the cylindrical outer surface, the closed gland groove comprising a fixed back slope and a wall that are both monolithic with the mandrel body and form the annular recess;

a sealing element positioned in axially retained by, and extending radially around the closed gland groove; and a continuous backup ring positioned proximate the sealing element in the closed gland groove, the continuous backup ring swaged into position by reducing a diameter of the continuous backup ring to be seated within the closed gland groove, wherein the continuous backup ring extends radially around the closed gland groove and rides along the back slope as the continuous backup ring expands radially outward from the mandrel body upon activation of the continuous backup ring, the continuous backup ring being in contact with the back slope prior to activation.

6. The system of claim 5, wherein the continuous backup ring comprises a continuous metal backup ring.

7. The system of claim 5, wherein a rate at which the continuous backup ring expands decreases as an angle of the back slope increases.

8. The system of claim 5, wherein an extrusion gap between the cylindrical outer surface of the mandrel body and the tubing is reduced upon activation of the continuous backup ring.

9. The system of claim 5, wherein the continuous backup ring expands in response to a setting force transferred to the continuous backup ring from the sealing element.

10. A method, comprising:

deploying a closed gland sealing system along a production tubing within a wellbore that is encased with wellbore casing, wherein the closed gland sealing system includes:

a mandrel body having a cylindrical outer surface, wherein a seal mandrel portion of the mandrel body comprises a closed gland groove comprising an annular recess formed in the mandrel body and extending radially around the cylindrical outer surface, the closed gland groove comprising a fixed back slope and a wall that are both monolithic with the mandrel body and form the annular recess;

a sealing element positioned in, and axially retained by, and extending radially around the closed gland groove; and a continuous backup ring positioned proximate with the sealing element in the closed gland groove, the continuous backup ring swaged into position by reducing a diameter of the continuous backup ring to be seated within the closed gland groove, wherein the continuous backup ring extends radially around the closed gland groove and rides along the back slope as the continuous backup ring expands radially outward from the seal mandrel portion of the mandrel body upon activation of the continuous backup ring, the continuous backup ring being in contact with the back slope prior to activation; and activating the continuous backup ring to reduce an extrusion gap between the cylindrical outer surface of the mandrel body and a seal bore.

11. The method of claim 10, wherein activating the continuous backup ring comprises transferring a setting force from the sealing element to the continuous backup ring.

12. The method of claim 10, wherein activating the continuous backup ring comprises increasing pressure forces experienced by the sealing element and the continuous backup ring.

13. The method of claim 10, further comprising: retracting the continuous backup ring by reducing pressure forces experienced by the sealing element and the continuous backup ring.

14. The method of claim 13, wherein retracting the continuous backup ring causes the continuous backup ring to drop down into the closed gland groove.

* * * * *